US009498991B2

(12) United States Patent
Miyamoto

(10) Patent No.: US 9,498,991 B2
(45) Date of Patent: Nov. 22, 2016

(54) LIQUID EJECTING APPARATUS AND LIQUID EJECTING METHOD

(71) Applicant: Seiko Epson Corporation, Tokyo (JP)

(72) Inventor: Toru Miyamoto, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/063,648

(22) Filed: Mar. 8, 2016

(65) Prior Publication Data

US 2016/0279983 A1 Sep. 29, 2016

(30) Foreign Application Priority Data

Mar. 27, 2015 (JP) ..... 2015-065910

(51) Int. Cl.
*B41J 25/00* (2006.01)

(52) U.S. Cl.
CPC ..... *B41J 25/001* (2013.01)

(58) Field of Classification Search
CPC ..... B41J 2/04508; B41J 2/04506; B41J 2/04505; B41J 2/04503; B41J 2/04501; B41J 2/0451; B41J 2/04511; B41J 2/04513; B41J 2/04515; B41J 2/04516; B41J 2/04518; B41J 2/0453; B41J 2/04531; B41J 2/04533; B41J 2/04535; B41J 2/04536; B41J 2/04538; B41J 2/0454; B41J 2/04541; B41J 2/04543; B41J 2/04545; B41J 2/04546; B41J 2/04548; B41J 2/04561; B41J 2/04563; B41J 2/04565; B41J 2/04566; B41J 2/04568; B41J 2/0457; B41J 2/04571;
(Continued)

(56) References Cited

U.S. PATENT DOCUMENTS 7,425,048 B2 * 9/2008 Sheahan ..... B41J 2/0451 347/14
7,681,970 B2 * 3/2010 Sheahan ..... B41J 2/0451 347/12
8,096,631 B2 * 1/2012 Kunimatsu ..... B41J 2/04513 347/12

FOREIGN PATENT DOCUMENTS

JP 11-245384 A 9/1999

* cited by examiner

*Primary Examiner* — Kristal Feggins
(74) *Attorney, Agent, or Firm* — Harness, Dickey & Pierce, P.L.C.

(57) ABSTRACT

A liquid ejecting apparatus includes a plurality of nozzles; a moving portion which moves the plurality of nozzles to the medium; and a control portion which controls the plurality of nozzles and the moving portion. The plurality of nozzles include a first-type nozzle group which records dots using a nozzle use rate which is less than a first threshold value; a second-type nozzle group which records dots using a nozzle use rate which is the first threshold value or more, and less than a second threshold value; and a third-type nozzle group which records dots using a nozzle use rate of the second threshold value or more. The control portion executes multipass recording in which recording of dots is completed using main scanning passes of N times, ejects the liquid in order of ejecting of the first-type nozzle group and the third-type nozzle group with respect to a first region, ejects the liquid using the second-type nozzle group with respect to a second region which is close to the first region, and ejects the liquid in order of ejecting of the third-type nozzle group and the first-type nozzle group with respect to a third region which is close to the second region, but is not close to the first region.

7 Claims, 12 Drawing Sheets

(58) Field of Classification Search
CPC ..... B41J 2/04573; B41J 2/04575; B41J 2/04576; B41J 2/04578; B41J 2/04593; B41J 2/04595; B41J 2/04596; B41J 2/04598; B41J 2/07; B41J 2/072; B41J 2/075; B41J 2/08; B41J 2/085; B41J 2/09; B41J 2/095; B41J 2/10; B41J 2/105; B41J 2/11; B41J 2/115; B41J 2/12; B41J 2/125; B41J 2/13; B41J 2002/022; B41J 25/001
See application file for complete search history.

LIQUID EJECTING APPARATUS AND LIQUID EJECTING METHOD

BACKGROUND

1. Technical Field

The present invention relates to a liquid ejecting apparatus and a liquid ejecting method.

2. Related Art

In JP-A-11-245384, an image forming method in which a predetermined raster line is formed using a plurality of printing passes by overlapping a part of a mask pattern has been proposed. In the image forming method which is described in JP-A-11-245384, an ejecting quantity which is even in each sending quantity is secured by setting a pattern of an ejecting quantity of dots to a trapezoidal shape.

However, in JP-A-11-245384, in a region which is formed using a plurality of printing passes (referred to as "pass"), there is a portion in which pass with low Duty (pass in which ejecting quantity of dot is small) is performed subsequent to pass with high Duty (pass in which ejecting quantity of dot is large), and a portion in which pass with high Duty is performed subsequent to pass with low Duty. Here, it is understood that there is a case in which a color variation periodically occurs, and unevenness occurs, since ink which is ejected in pass with high Duty is hardly dried, and bleeding on a medium is different in a case in which pass with high Duty is previously performed, and a case in which pass with low Duty is previously performed.

SUMMARY

The invention can be realized as the following aspects and application examples.

(1) According to an aspect of the invention, a liquid ejecting apparatus is provided. The liquid ejecting apparatus includes a plurality of nozzles which eject liquid onto a medium; a moving portion which relatively moves the plurality of nozzles to the medium; and a control portion which controls the plurality of nozzles and the moving portion, in which the plurality of nozzles include a first-type nozzle group which records dots by ejecting the liquid using a nozzle use rate which is less than a first threshold value, a second-type nozzle group which records dots by ejecting the liquid using a nozzle use rate which is the first threshold value or more, and less than a second threshold value, and a third-type nozzle group which records dots by ejecting the liquid using a nozzle use rate of the second threshold value or more, and the control portion executes multipass recording in which recording of dots on a main scanning line is completed using main scanning passes of N times (N is integer of 2 or more), ejects the liquid in order of ejecting of the first-type nozzle group and the third-type nozzle group with respect to a first region on the medium, ejects the liquid using the second-type nozzle group with respect to a second region which is close to the first region, and ejects the liquid in order of ejecting of the third-type nozzle group and the first-type nozzle group with respect to a third region which is close to the second region, but is not close to the first region. According to the aspect, it is possible to make unevenness hardly visible, since liquid is ejected using the second-type nozzle group of which a nozzle use rate is between the first threshold value and the second threshold value, between the first region in which a nozzle use rate in the first pass is lower than the first threshold value, ejected liquid easily dries, and bleeding hardly occurs and the third region in which a nozzle use rate in the first pass is higher than the second threshold value, ejected liquid hardly dries, and bleeding easily occurs.

(2) In the liquid ejecting apparatus, the number of nozzles of the first-type nozzle group and the number of nozzles of the third-type nozzle group may be the same. According to the aspect, it is possible to make sizes of the first region and the third region the same, and to make a sum of nozzle use rates of the first region, the second region, and the third region equal.

(3) In the liquid ejecting apparatus, the number of nozzles of the first-type nozzle group, the number of nozzles of the second-type nozzle group, and the number of nozzles of the third-type nozzle group may be the same. According to the aspect, since sizes of the first region, the second region, and the third region are the same, it is possible to make unevenness hardly visible.

(4) In the liquid ejecting apparatus, the number of times of scanning which is performed while ejecting the liquid, and is necessary for forming the second region may be smaller than the number of times of scanning which is performed while ejecting the liquid, and is necessary for forming the first region, and may be smaller than the number of times of scanning which is performed while ejecting the liquid, and is necessary for forming the third region. According to the aspect, it is possible to make a sum of the nozzle use rates of the first region, the second region, and the third region equal.

(5) In the liquid ejecting apparatus, the first-type nozzle group, the second-type nozzle group, and the third-type nozzle group may be arranged in order of the first-type nozzle group, the second-type nozzle group, the third-type nozzle group, the second-type nozzle group, and the first-type nozzle group in a sub-scanning direction. According to the aspect, it is possible to set the first region and the third region not to be close to each other.

(6) In the liquid ejecting apparatus, the nozzle use rate of the first-type nozzle group may be 0% or more, and less than 40%, the nozzle use rate of the second-type nozzle group may be 40% or more, and less than 60%, and the nozzle use rate of the third-type nozzle group may be 60% or more, and 100% or less. When the nozzle use rates are in these ranges, it is possible to make unevenness more invisible.

The invention can be realized in various forms, and for example, can be realized in various forms such as a liquid ejecting method, in addition to a liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
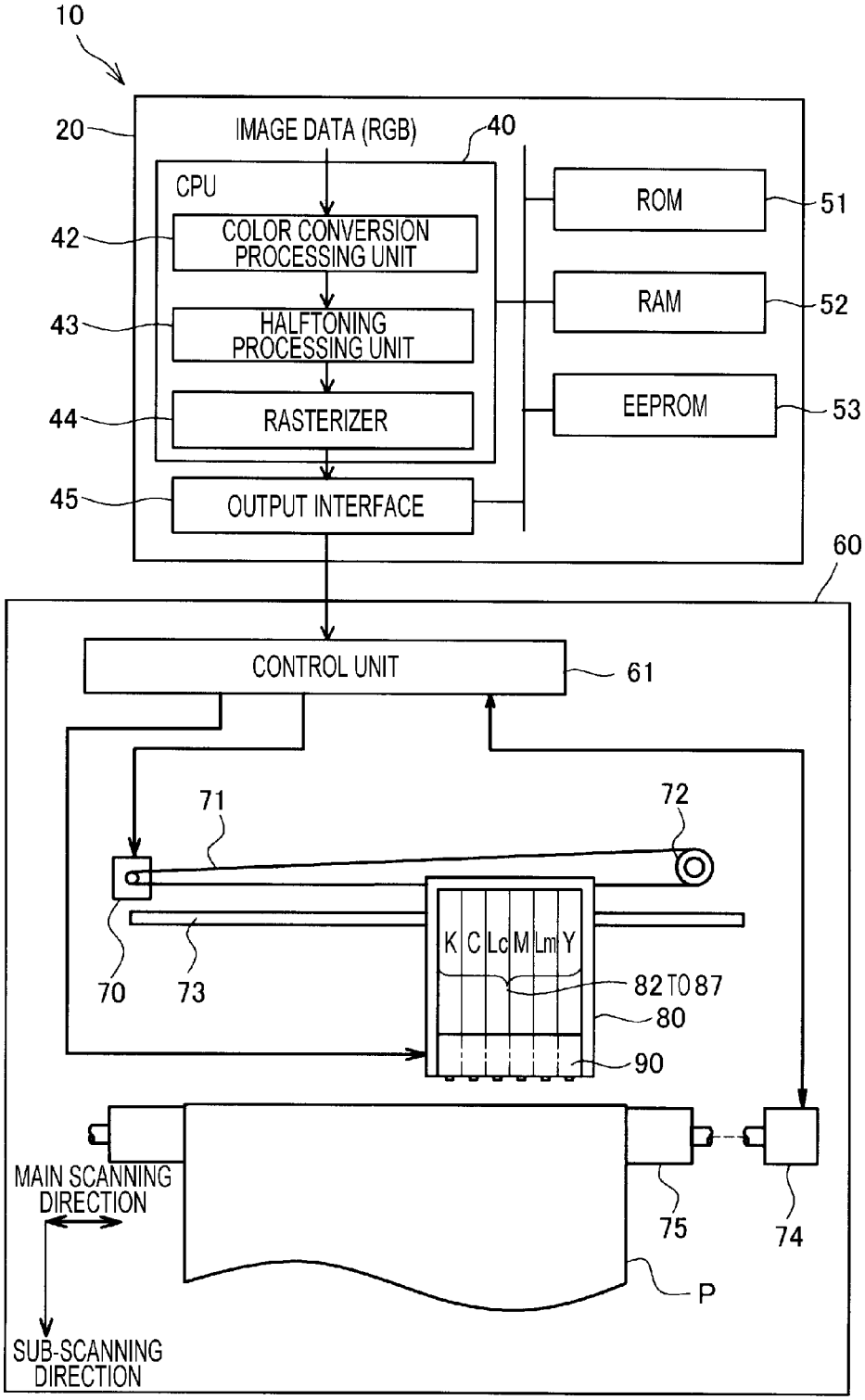
FIG. 1 is an explanatory diagram which illustrates a configuration of a liquid ejecting system.

FIG. 1 is an explanatory diagram which illustrates a configuration of a liquid ejecting system. A liquid ejecting system 10 includes an image processing unit 20, and a liquid ejecting apparatus 60. The image processing unit 20 generates printing data for the liquid ejecting apparatus 60 from image data (for example, image data of RGB).

The image processing unit 20 includes a CPU 40 (also referred to as "control section 40"), a ROM 51, a RAM 52, an EEPROM 53, and an output interface 45. The CPU 40 has a function as a color conversion processing unit 42, a halftoning processing unit 43, and a rasterizer 44. These functions are executed using a computer program. The color conversion processing unit 42 converts multi-grayscale RGB data into ink amount data which denotes an ink amount of ink of a plurality of colors. The halftoning processing unit 43 creates dot data which denotes a dot forming state in each pixel by executing a halftoning process with respect to ink amount data. The rasterizer 44 rearranges dot data which is generated by the halftoning process to dot data which is used in individual main scanning using the liquid ejecting apparatus 60. Hereinafter, dot data for each main scanning which is generated in the rasterizer 44 will be referred to as "raster data". Operations of dot recording which will be described in the following various embodiments are rasterizing operations (that is, operation which is expressed using raster data) which are executed using the rasterizer 44.

The liquid ejecting apparatus 60 is, for example, a serial-type ink jet printer, and includes a control portion 61, a carriage motor 70, a driving belt 71, a pulley 72, a sliding shaft 73, a sheet feeding motor 74, a sheet feeding roller 75, a carriage 80, ink cartridges 82 to 87, and a recording head 90.

The driving belt 71 is stretched between the carriage motor 70 and the pulley 72. The carriage 80 is attached to the driving belt 71. The ink cartridges 82 to 87 in which, for example, cyan ink (C), magenta ink (M), yellow ink (Y), black ink (B), light cyan ink (Lc), and a light magenta ink (Lm) are respectively accommodated are mounted on the carriage 80. In addition, as ink, it is possible to use various inks other than those in this example. Nozzle columns which correspond to the above described ink of each color are formed in the recording head 90 which is located under the carriage 80. When these ink cartridges 82 to 87 are mounted on the carriage 80 from above, it is possible to supply ink to the recording head 90 from each cartridge. The sliding shaft 73 is arranged in parallel to the driving belt, and passes through the carriage 80.

When the carriage motor 70 drives the driving belt 71, the carriage 80 moves along the sliding shaft 73. This direction is referred to as a "main scanning direction". The carriage motor 70, the driving belt 71, and the sliding shaft 73 configure a main scanning driving mechanism. The ink cartridges 82 to 87 and the recording head 90 also move in the main scanning direction along with movement of the carriage 80 in the main scanning direction. Dot recording on a recording medium P is executed when ink is ejected onto the recording medium P (typically, printing sheet) from nozzles (which will be described later) which are arranged in the recording head 90 when the recording head moves in the main scanning direction. In this manner, movement of the recording head 90 in the main scanning direction, and ejecting of ink are referred to as main scanning, and first main scanning is referred to as "main scanning pass", or as "pass", simply.

The sheet feeding roller 75 is connected to the sheet feeding motor 74. When performing recording, the recording medium P is inserted onto the sheet feeding roller 75. The recording medium P corresponds to a "medium" in claims. When the carriage 80 moves up to an end portion in the main scanning direction, the control portion 61 rotates the sheet feeding motor 74. In this manner, the sheet feeding roller 75 also rotates, and moves the recording medium P. A relative movement direction between the recording medium P and the recording head 90 is referred to as the sub-scanning direction". The sheet feeding motor 74 and the sheet feeding roller 75 configure a sub-scanning driving mechanism. The sub-scanning direction is a direction which is perpendicular to the main scanning direction (orthogonal direction). However, the sub-scanning direction and the main scanning direction are not necessarily orthogonal to each other, and may intersect each other. In addition, normally, a main scanning operation and a sub-scanning operation are alternately executed. The above described main scanning driving mechanism and sub-scanning driving mechanism configure a moving portion in claims. In addition, as a dot recording operation, it is possible to execute at least one of a unidirectional recording operation in which dot recording is performed using only main scanning of an outward path and a bidirectional recording operation in which dot recording is performed using main scanning of both the outward path and a return path. Since a direction in main scanning is merely reversed in main scanning of the outward path and main scanning of the return path, hereinafter, descriptions will be made without classifying an outward path and a return path as long as it is not particularly necessary.

The image processing unit 20 may be integrally configured with the liquid ejecting apparatus 60. In addition, the image processing unit 20 may be configured separately from the liquid ejecting apparatus 60 by being stored in a computer (not illustrated). In this case, the image processing unit 20 may be executed using a CPU as printer driver software (computer program) in the computer.

Figure 2:
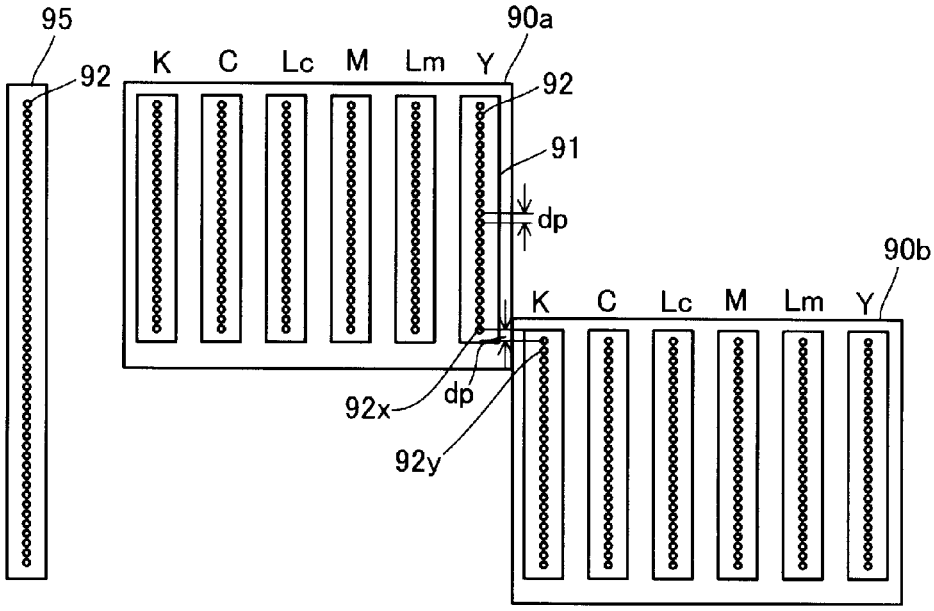
FIG. 2 is an explanatory diagram which illustrates an example of a configuration of a nozzle column of a recording head.

FIG. 2 is an explanatory diagram which illustrates an example of a configuration of nozzle columns of the recording head 90. In addition, in FIG. 2, two recording heads 90 are illustrated. However, in the recording head 90, it may be possible to assume one head as two virtual heads, and the recording head 90 may be two or more. Two recording heads 90*a* and 90*b* include a nozzle column 91 for each color, respectively. Each nozzle column 91 includes a plurality of nozzles 92 which are aligned in the sub-scanning direction at a regular nozzle pitch dp. A nozzle 92*x* at an end portion of a nozzle column 91 of a first recording head 90*a*, and a nozzle 92*y* at an end portion of a nozzle column 91 of a second recording head 90*b* are shifted by the same size of the nozzle pitch dp in the nozzle column 91 in the sub-scanning direction. In this case, nozzle columns of one color of the two recording heads 90*a* and 90*b* are equivalent to a nozzle column 95 (illustrated on left side in FIG. 2) which includes twice the number of nozzles of one color of one recording head 90.

Hereinafter, a method of performing dot recording of one color using the equivalent nozzle column 95 will be described. In addition, according to the first embodiment, the nozzle pitch dp and a pixel pitch on the recording medium P are the same. However, it is also possible to set the nozzle pitch dp to an integer multiple of the pixel pitch on the recording medium P. In the latter case, so-called interlace recording (operation in which dot is recorded using pass after second pass so that gap between dots between scanning lines which are recorded using first pass is filled) is performed. The nozzle pitch dp is, for example, a value corresponding to 720 dpi (0.035 mm).

Figure 3:
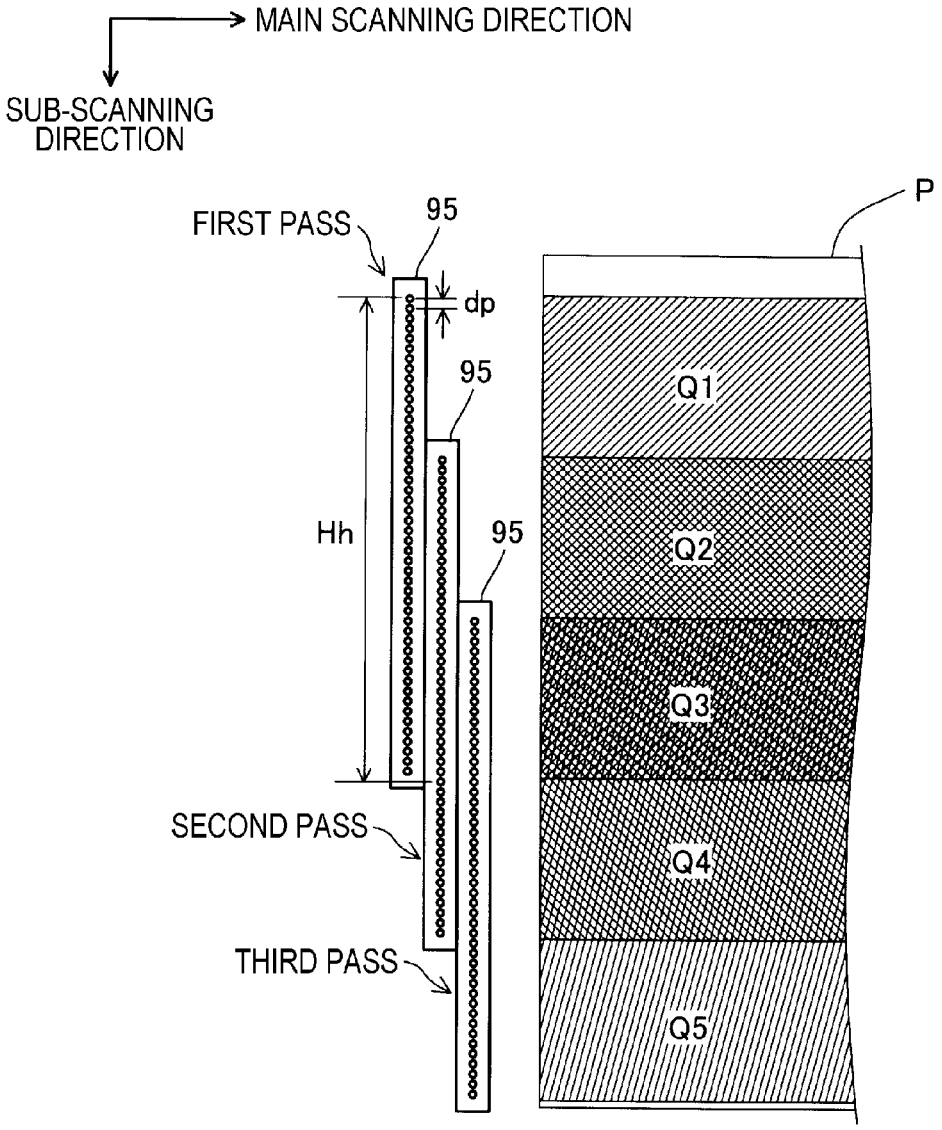
FIG. 3 is an explanatory diagram which illustrates positions of nozzle columns in three main scanning passes, and recording regions in the positions.

FIG. 3 is an explanatory diagram which illustrates positions of the nozzle columns 95 in three main scanning passes, and recording regions in the positions. Hereinafter, a case in which dots are formed in all of pixels of the recording medium P using ink of one color (for example, cyan ink) will be described as an example. In the first embodiment, multipass recording in which dots are recorded in a predetermined region using main scanning passes of three times will be performed. In pass in the first time (n+1th pass (n is integer of zero or more)) (described as first pass in FIG. 3), and in pass in the second time (n+2th pass) (described as second pass in FIG. 3), positions of the nozzle columns 95 are shifted by a distance corresponding to ⅓ of the head height Hh in the sub-scanning direction. Here, the "head height Hh" means a distance which is denoted using M×dp (M is the number of nozzles of nozzle column 95, and dp is nozzle pitch).

In the n+1th pass, on the recording medium P, dot recording is executed by ejecting ink in a part of all the pixels on the main scanning lines of regions Q1, Q2, and Q3. In the n+2th pass, on the recording medium P, dot recording is executed by ejecting ink in a part of all the pixels on the main scanning lines of regions Q2, Q3, and Q4. In the n+3th pass, on the recording medium P, dot recording is executed by ejecting ink in a part of all the pixels on the main scanning lines of regions Q3, Q4, and Q5. In the region Q3, recording is completed using passes of three times of the n+1th pass, the n+2th pass, and the n+3th pass in total. In addition, here, a case in which an image (solid image) which forms dots in all the pixels of the recording medium P is assumed; however, a recording image (printing image) which is denoted by actual dot data includes pixels which actually form dots on the recording medium P, and pixels which do not actually form dots on the recording medium P. That is, whether or not to actually form dots in each pixel of the recording medium P is determined by dot data which is formed using a halftoning process. In the specification, the term "dot recording" means "forming of dots or non-forming of dots". In addition, the term "performing dot recording" is not related with whether or not to form dots by actually ejecting ink onto the recording medium P, and is used as a term which means "corresponding to dot recording".

Figure 4:
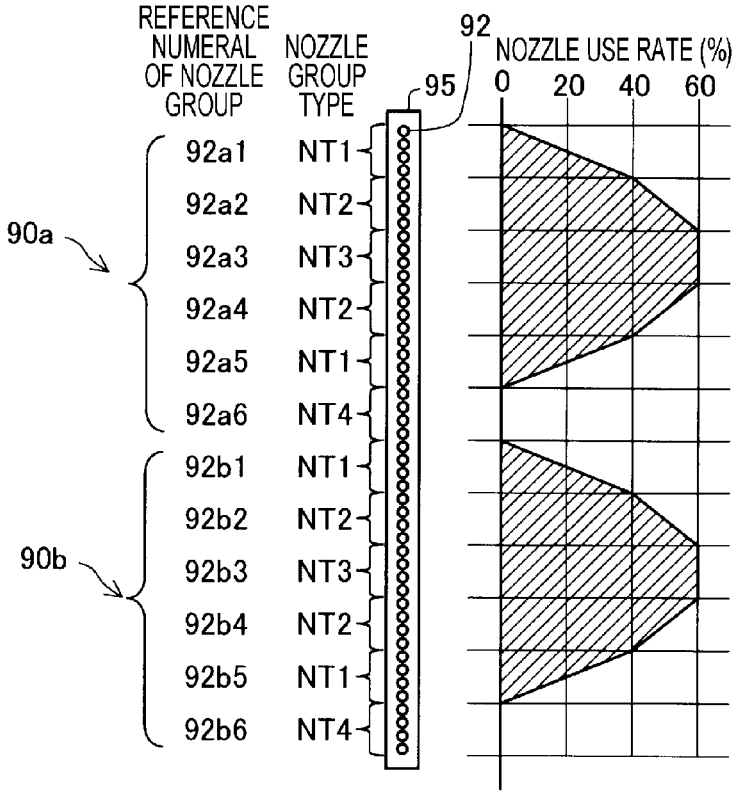
FIG. 4 is an explanatory diagram which illustrates a relationship between a nozzle and a nozzle use rate.

FIG. 4 is an explanatory diagram which illustrates a relationship between a nozzle and a nozzle use rate. The head 90*a* includes six nozzle groups 92*a*1 to 92*a*6 which align in order in the sub-scanning direction. The other head 90*b* also includes six nozzle groups 92*b*1 to 92*b*6, similarly. In addition, an individual nozzle group is configured of a plurality of nozzles which align at the regular nozzle pitch dp (FIG. 2) in the sub-scanning direction. These nozzle groups are classified into four-types of nozzle groups of NT1 to NT4. The "nozzle use rate" means a ratio of the number of dots which is recorded in the nozzle 92 in one main scanning operation to the total number of dots in the main scanning direction. When setting a first threshold value TH1 to 40%, and a second threshold value TH2 to 60%, a nozzle use rate of a first-type nozzle group NT1 is 0% or more, and less than 40%, and is a nozzle use rate which is less than the first threshold value TH1. A nozzle use rate of a second-type nozzle group NT2 is 40% or more, and less than 60%, and is a small nozzle use rate which is the first threshold value TH1 or more, and less than the second threshold value TH2. A nozzle use rate of a third-type nozzle group NT3 is 60%, and is the second threshold value TH2 or more. In addition, a nozzle use rate of a fourth-type nozzle group NT4 is 0%, and ink is not ejected therefrom. The first-type nozzle group NT1 corresponds to the first-type nozzle group in claims, and the second-type nozzle group NT2, and the third-type nozzle group NT3 respectively correspond to the second-type nozzle group and the third-type nozzle group in claims. The nozzle group 92*a*1 belongs to the first-type nozzle group NT1. The nozzle group 92*a*2 belongs to the second-type nozzle group NT2. A nozzle group 92*a*3 belongs to the third-type nozzle group NT3. A nozzle group 92*a*4 belongs to the second-type nozzle group NT2. A nozzle group 92*a*5 belongs to the first-type nozzle group NT1. A nozzle group 92*a*6 belongs to the fourth-type nozzle group NT4.

Figure 5:
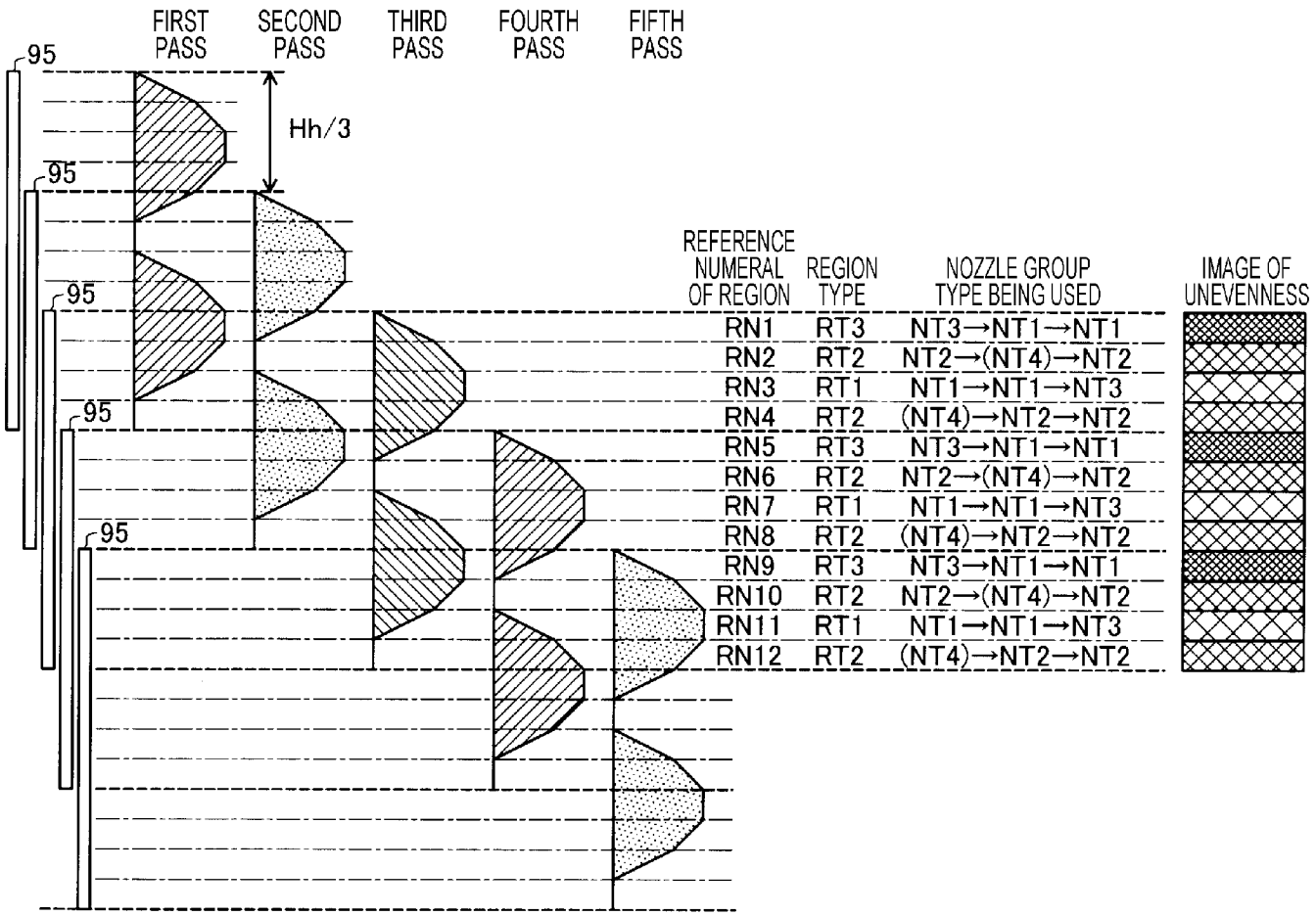
FIG. 5 is an explanatory diagram which illustrates a nozzle use rate and an image of unevenness in dot recording in passes of five times.

FIG. 5 is an explanatory diagram which illustrates nozzle use rates and images of unevenness in dot recording in passes of five times. When the third pass is completed, dot recording in regions RN1 to RN4 is completed. In addition, when the fourth pass is completed, dot recording in regions RN5 to RN8 is completed, and when the fifth pass is completed, dot recording in regions RN9 to RN12 is completed. In addition, regions other than the regions RN1 to RN12 are not subjected to recording of passes of three times, and are in an unfinished state.

The regions RN1 to RN12 can be classified into three region types of RT1 to RT3. In a region of a first region type RT1, dots are recorded using nozzles of the first-type nozzle group NT1 in the first and second passes, and dots are recorded using nozzles of the third-type nozzle group NT3 in the third pass (NT1→NT1→NT3). In a second region type RT2, dots are recorded using nozzles of the second-type nozzle group NT2 in the second pass among passes of three times. In addition, residual pass of one time scanning is performed using nozzles which belong to the fourth-type nozzle group NT4, and dots are not recorded. In a region of a third region type RT3, dots are recorded using nozzles of the third-type nozzle group NT3 in the first pass, and dots are recorded using nozzles of the first-type nozzle group NT1 in the second and third passes (NT3→NT1→NT1). A region of the second region type RT2 is close to a region of the first region type RT1, and a region of the third region type RT3 is close to a region of the second region type RT2; however, it is not close to a region of the first region type RT1. A region of the first region type RT1 corresponds to the first region in claims, and regions of the second region type RT2 and the third region type RT3 respectively correspond to the second region and the third region in claims. According to the first embodiment, a region of the first region type RT1 and a region of the third region type RT3 are not close to each other, and a region of the second region type RT2 is provided between a region of the first region type RT1 and a region of the third region type RT3.

Since a nozzle use rate of a region of the third region type RT3 is high in the first pass, ink hardly dries after ejecting of ink onto a recording medium P. On the other hand, since a nozzle use rate of a region of the first region type RT1 is low in the first pass, ink easily dries after ejecting of ink onto the recording medium P. It is understood that a bleeding state of ink when the subsequent ink is ejected is different between a case in which ink in the subsequent pass is ejected before sufficient drying of ink and a case in which ink in the subsequent pass is ejected after sufficient drying of ink. It is understood that unevenness occurs due to a different bleeding state of ink, and the unevenness becomes conspicuous, when a region in which ink in the subsequent pass is ejected before sufficient drying of ink (region of third region type RT3 in first embodiment), and a region in which ink in the subsequent pass is ejected after sufficient drying of ink (region of first region type RT1 in first embodiment) are close to each other. The inventor of the application found that unevenness becomes hardly visible, when ink is ejected using a nozzle use rate which is larger than a nozzle use rate in the first pass of the first region type RT1, but is smaller than a nozzle use rate in the first pass of the third region type RT3 between a region of the first region type RT1 and a region of the third region type RT3. That is, by providing an intermediate region (region of second region type RT2) between a region in which bleeding hardly occurs (region of first region type RT1) and a region in which bleeding easily occurs (region of third region type RT3), unevenness becomes hardly visible.

In addition, according to the first embodiment, since the number of times in which scanning is performed while ejecting ink in order to form a region of the second region type RT2 is smaller than the number of times in which scanning is performed while ejecting ink in order to form a region of the first region type RT1, and is smaller than the number of times in which scanning is performed while ejecting ink in order to form a region of the third region type RT3, it is possible to set a sum of nozzle use rates of a region of the first region type RT1, a region of the second region type RT2, and a region of the third region type RT3 to be the same (100%).

Figure 6:
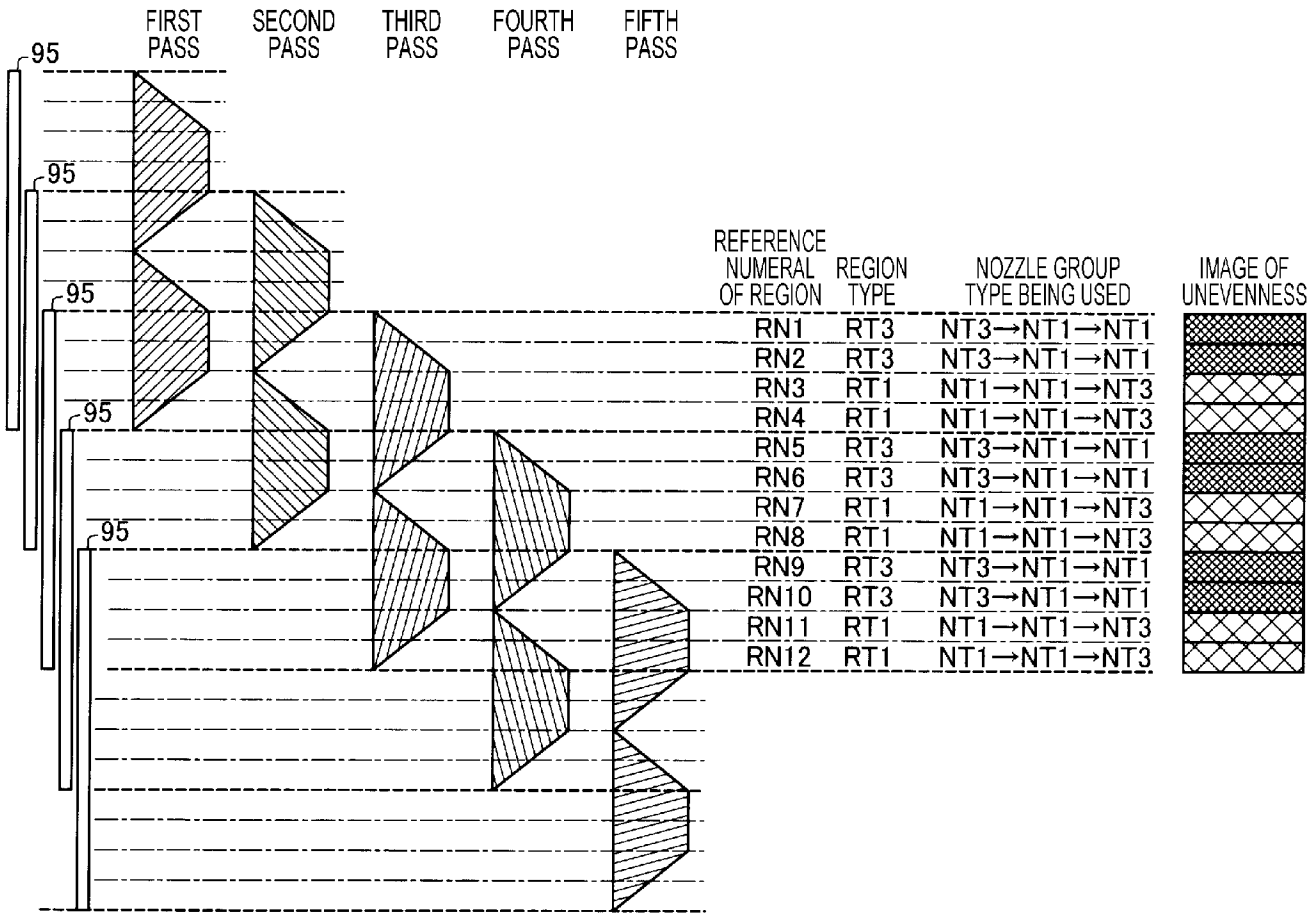
FIG. 6 is an explanatory diagram which illustrates a nozzle use rate and an image of unevenness in dot recording in passes of five times in a comparison example.

FIG. 6 is an explanatory diagram which illustrates a nozzle use rate and an image of unevenness in dot recording of passes of five times in a comparison example. Also in the comparison example, similarly to that in the first embodiment, reference numerals of regions RN1 to RN12 with respect to a region in which recording is completed using passes of five times. The regions RN1 to RN12 in the comparison example are divided into two regions of a region of the first region type RT1 and a region of the third region type RT3, and there is no region of the second region type RT2. As a result, the region of the first region type RT1 and the region of the third region type RT3 are close to each other so that the region RN2 (region of the third region type RT3) and the region RN3 (region of the first region type RT1) are close to each other. That is, since a region in which bleeding hardly occurs (region of first region type RT1) and a region in which bleeding easily occurs (region of third region type RT3) are close to each other, unevenness becomes conspicuous compared to the first embodiment. That is, it can be said that unevenness is hardly visible in the first embodiment compared to the comparison example.

As described above, according to the first embodiment, ink is ejected to a region of the first region type RT1 in order of the first-type nozzle group NT1, and the third-type nozzle group NT3, ink is ejected from the second-type nozzle group NT2 to a region of the second region type RT2 which is close to a region of the first region type RT1, and the ink is ejected in order of the third-type nozzle group NT3, and the first-type nozzle group NT1 with respect to a region of the third region type RT3 which is close to the region of the second region type RT2, but is not close to the region of the first region type RT1. As a result, it is possible to make unevenness hardly visible compared to a case in which the region of the second region type RT2 is not provided between the region of the first region type RT1 and the region of the third region type RT3.

Second Embodiment

Figure 7:
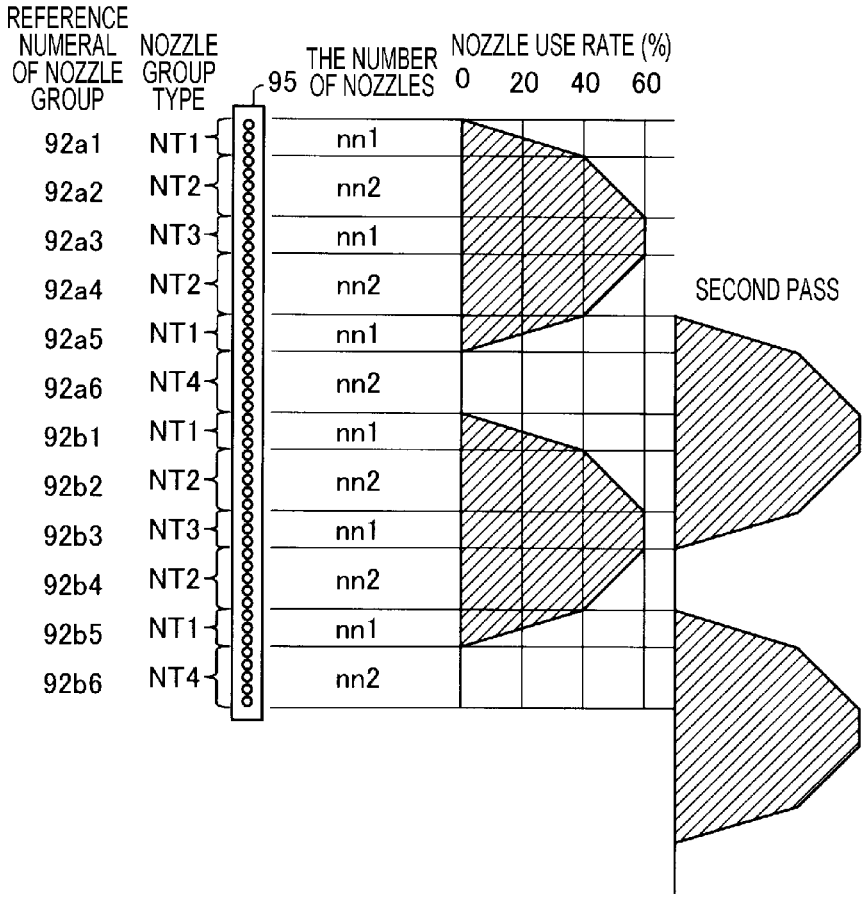
FIG. 7 is an explanatory diagram which illustrates a second embodiment.

FIG. 7 is an explanatory diagram which illustrates a second embodiment. In the first embodiment, the number of nozzles of the six nozzle groups 92*a*1 to 92*a*6 are the same; however, according to the second embodiment, the number of nozzles is different, for example, the number of nozzles of the nozzle groups 92*a*1 and 92*a*5 (nozzle group of first-type nozzle group NT1), and the nozzle group 92*a*3 (nozzle group of third-type nozzle group NT3) are nn1, the number of nozzles of the nozzle groups 92*a*2 and 92*a*4 (nozzle group of second-type nozzle group NT2), and the nozzle group 92*a*6 (nozzle group of fourth-type nozzle group NT4) are nn2 (nn1<nn2), and the number of nozzles is different, and in which nn1+nn2 is ⅙ the number of nozzles of the nozzle column 95. The number of nozzles corresponding to ⅓ of the head height Hh is 2×(nn1+nn2). Also in the second embodiment, similarly to that in the first embodiment, in a region of the first region type RT1, dots are recorded using nozzles of the first-type nozzle group NT1 in the first and second passes, and dots are recorded using nozzles of the third region type RT3 in the third pass (NT1→NT1→NT3), the second region type RT2 is close to a region of the first region type RT1, and dots are recorded using nozzles of the second-type nozzle group NT2 in the second pass among passes of three times, and in the third region type RT3, dots are recorded using nozzles of the third-type nozzle group NT3 in the first pass, and are recorded using nozzles of the first-type nozzle group NT1 in the second and third passes (NT3→NT1→NT1). The region of the second region type RT2 is close to the region of the first region type RT1, and the region of the third region type RT3 is close to the region of the second region type RT2, but is not close to the region of the first region type RT1.

According to the second embodiment, similarly to that in the first embodiment, it is possible to make unevenness hardly visible compared to a case in which a region of the second region type RT2 is not provided between a region of the first region type RT1 and a region of the third region type RT3.

Third Embodiment

Figure 8:
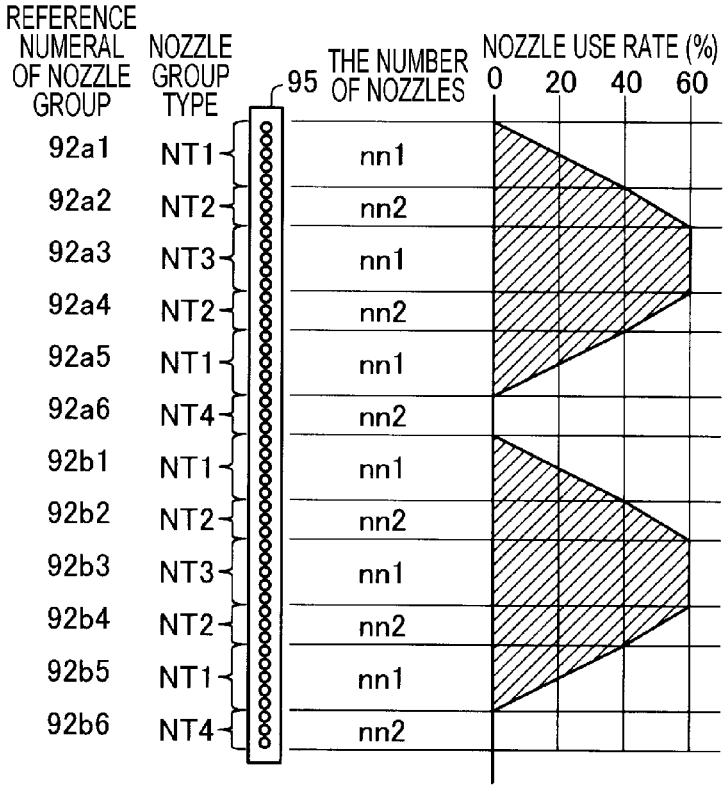
FIG. 8 is an explanatory diagram which illustrates a third embodiment.

FIG. 8 is an explanatory diagram which illustrates a third embodiment. A difference from the second embodiment is that the number of nozzles nn1 of the nozzle groups 92*a*1, 92*a*3, and 92*a*5 are larger than the number of nozzles nn2 of the nozzle groups 92*a*2, 92*a*4, and 92*a*6. Descriptions will be omitted; however, according to the third embodiment, it is possible to make unevenness hardly visible compared to a case in which a region of the second region type RT2 is not provided between a region of the first region type RT1 and a region of the third region type RT3, similarly to that in the first and the second embodiments.

As described above, as is understood from the first, second, and the third embodiments, the number of nozzles of the first-type nozzle group NT1 and the number of nozzles of the third-type nozzle group NT3 may be the same, and the number of nozzles of the second-type nozzle group NT2 and the number of nozzles of the fourth-type nozzle group NT4 may be the same. Since it is possible to set sizes of a region of the first region type RT1 and a region of the third region type RT3 in the sub-scanning direction to be the same, and to set a sum of nozzle use rates of a region of the first region type RT1, a region of the second region type RT2, and a region of the third region type RT3 to be equal, it is possible to make unevenness hardly visible. In addition, as in the first embodiment, the number of nozzles of the first-type nozzle group NT1, the number of nozzles of the second-type nozzle group NT2, the number of nozzles of the third-type nozzle group NT3, and the number of nozzles of the fourth-type nozzle group NT4 may be the same. Since it is possible to set sizes of the region of the first region type RT1, the region of the second region type RT2, and the region of the third region type RT3 in the sub-scanning direction to be the same, it is possible to make unevenness hardly visible.

Fourth Embodiment

Figure 9:
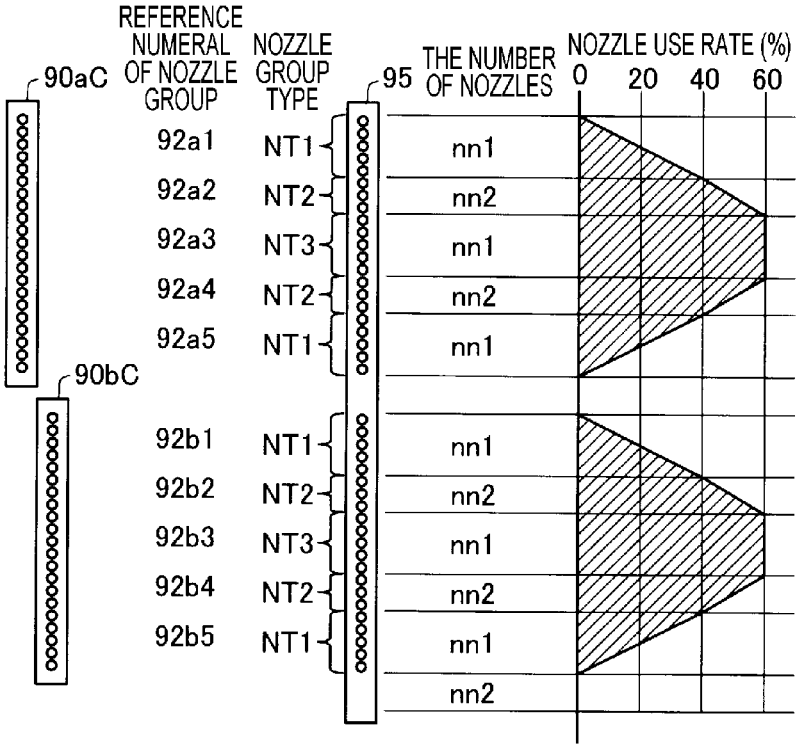
FIG. 9 is an explanatory diagram which illustrates a fourth embodiment.

FIG. 9 is an explanatory diagram which illustrates a fourth embodiment. A nozzle column 95 according to the fourth embodiment is a nozzle column 95 in which nozzles of the fourth-type nozzle group NT4 are removed from the nozzle column 95 according to the third embodiment. Two recording heads 90*a*C and 90*b*C of cyan are arranged by being separated by an interval corresponding to the number of nozzles of the fourth-type nozzle group NT4. Since nozzles of the fourth-type nozzle group NT4 do not eject ink, the nozzles of the fourth-type nozzle group NT4 may not be provided. Similarly to the first to third embodiments, it is possible to make unevenness hardly visible. In addition, the first and second embodiments may also have a configuration in which nozzles of the fourth-type nozzle group NT4 are not provided, similarly to the fourth embodiment.

Fifth Embodiment

Figure 10:
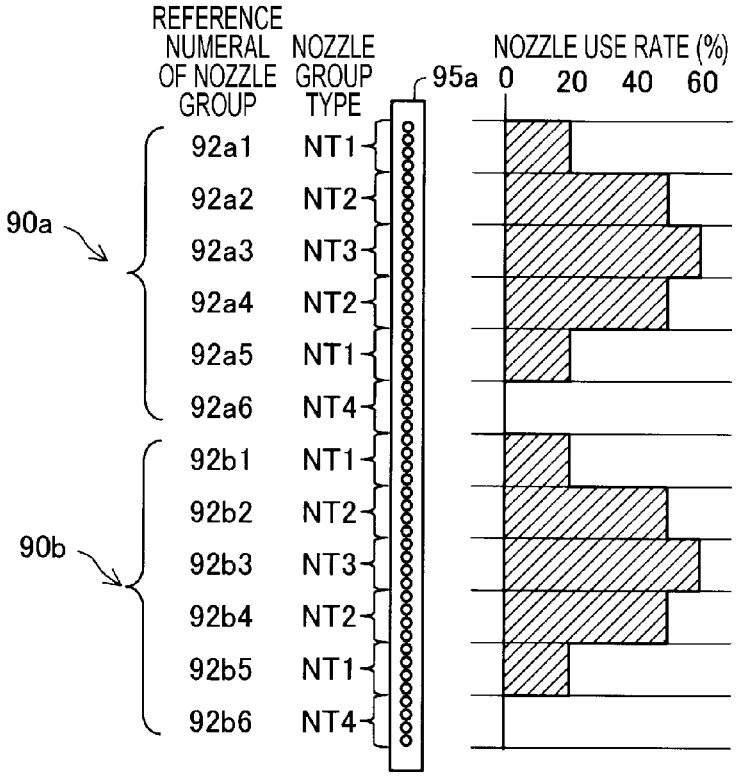
FIG. 10 is an explanatory diagram which illustrates a fifth embodiment.

FIG. 10 is an explanatory diagram which illustrates a fifth embodiment. In the first to fourth embodiments, a nozzle use rate becomes high toward a center side of the head 90*a*, and becomes low toward an end side of the head 90*a* so that a nozzle use rate of nozzles of the first-type nozzle group NT1 is high on the second-type nozzle group NT2 side, and is low on a side opposite thereto, and a nozzle use rate of nozzles of the second-type nozzle group NT2 is high on the third-type nozzle group NT3 side, and is low on the first-type nozzle group NT1 side. In contrast to this, the fifth embodiment is different from the first to fourth embodiments in a point that a nozzle use rate of nozzles of the first-type nozzle group NT1 is 20%, and is the same nozzle use rate regardless of a nozzle position, a nozzle use rate of nozzles of the second-type nozzle group NT2 is 50%, and a nozzle use rate of nozzles of the third-type nozzle group NT3 is 50%, and is the same nozzle use rate regardless of a nozzle position. In addition, according to the embodiment, a first threshold value TH1 is 30%, and a second threshold value TH2 is 55%. In this manner, a nozzle use rate of each nozzle in each nozzle group type may be the same, may be high toward the center side of the head 90*a*, and may be low toward the end of the head 90*a*. The same is applied to nozzles of the head 90*b*.

Sixth Embodiment

Figure 11:
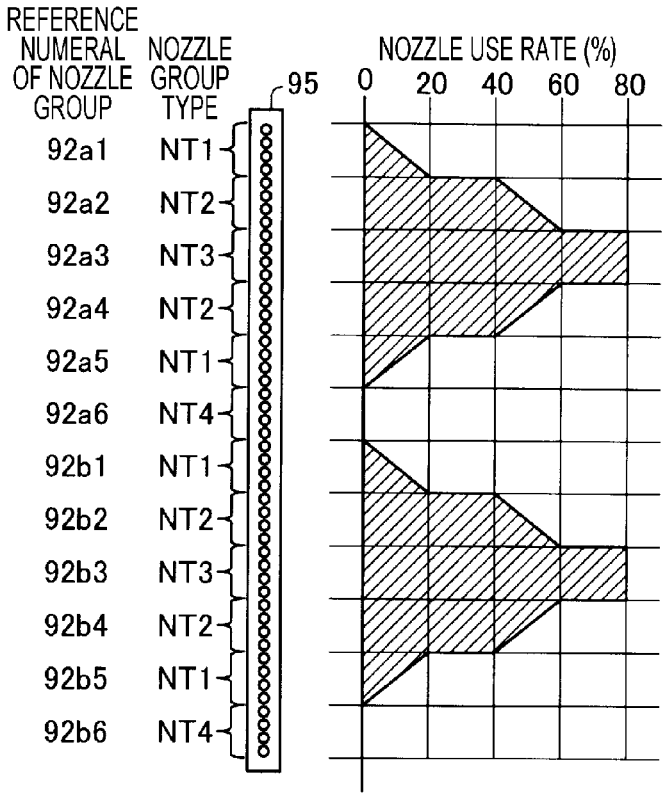
FIG. 11 is an explanatory diagram which illustrates a sixth embodiment.

FIG. 11 is an explanatory diagram which illustrates a sixth embodiment. In the first to fourth embodiments, nozzle use rates of two nozzle group types are set to the same value at positions at which the two nozzle group types are close to each other; however, according to the sixth embodiment, nozzle use rates of two nozzle groups are set to different values at positions at which the two nozzle group types are close to each other. In this manner, it is possible to adopt various values of nozzle use rates, and various shapes.

Seventh Embodiment

Figure 12:
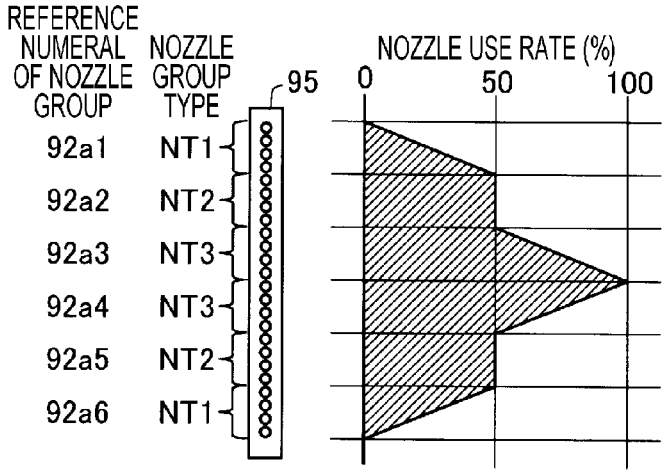
FIG. 12 is an explanatory diagram which illustrates a seventh embodiment.

FIG. 12 is an explanatory diagram which illustrates a seventh embodiment. In the first to sixth embodiments, multipass recording in which dot recording is completed using passes of three times is adopted; however, according to the seventh embodiment, multipass recording in which dot recording is completed using passes of two times is adopted. A nozzle column 95 includes six nozzle groups of 92*a*1 to 92*a*6 which align in the sub-scanning direction. The nozzle groups 92*a*1 and 92*a*6 are a first-type nozzle group NT1, nozzle groups 92*a*2 and 92*a*5 are a second-type nozzle group NT2, and nozzle groups 92*a*3 and 92*a*4 are a third-type nozzle group NT3. In addition, the nozzle groups 92*a*3 and 92*a*4 are close to each other. The number of nozzles (size in sub-scanning direction) of six nozzle groups of 92*a*1 to 92*a*6 is the same; however, the number of nozzles (size in sub-scanning direction) of the nozzle groups 92*a*1, 92*a*3, 92*a*4, and 92*a*6 of the first-type nozzle group NT1 and third-type nozzle group NT3 may be set to be the same, and the number of nozzles (size in sub-scanning direction) of the two nozzle groups 92*a*2 and 92*a*5 of the second-type nozzle group NT2 may be set to be the same.

Figure 13:
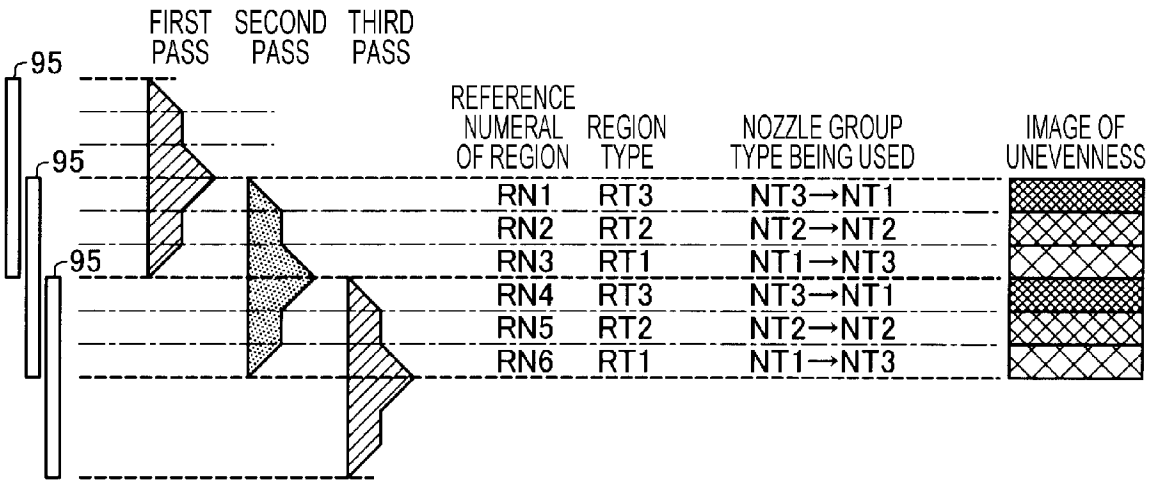
FIG. 13 is an explanatory diagram which illustrates a nozzle use rate and an image of unevenness in dot recording in passes of three times.

FIG. 13 is an explanatory diagram which illustrates a nozzle use rate and an image of unevenness in dot recording of passes of three times. When scanning in the second pass is completed, dot recording in regions RN1 to RN3 is completed, and when scanning in the third pass is completed, dot recording of regions RN4 to RN6 is completed. The regions RN1 to RN6 can be classified into three region types of RT1 to RT3. The regions RN3 and RN6 are regions of a first region type RT1, dots are recorded using nozzles of a first-type nozzle group NT1 in the first pass, and are recorded using nozzles of a third-type nozzle group NT3 in the second pass. The regions RN1 and RN4 are regions of a third region type RT3, dots are recorded using nozzles of the third-type nozzle group NT3 in the first pass, and are recorded using nozzles of the first-type nozzle group NT1 in the second pass. The regions RN2 and RN5 are regions of a second region type RT2, and dots are recorded using nozzles of a second-type nozzle group NT2 in both passes of two times. Also in the seventh embodiment, a region of the second region type RT2 is close to a region of the first region type RT1, and a region of the third region type RT3 is close to the region of the second region type RT2, but is not close to the region of the first region type RT1. Accordingly, since an intermediate region (region of second region type RT2) is provided between a region in which bleeding hardly occurs (region of first region type RT1) and a region in which bleeding easily occurs (region of third region type RT3), unevenness is hardly visible.

In the first to sixth embodiments, two heads 90 (90*a* and 90*b*) are provided; however, in the seventh embodiment, there is only one head 90*a*. In this manner, the number of heads may be one, or may be two. In addition, there may be a plurality of heads of three or more.

Modification Example 1

In addition, in the above described embodiments, the recording head is described as a recording head which moves in the main scanning direction; however, when it is possible to eject ink by relatively moving a recording medium and a recording head in the main scanning direction, it is not limited to the above described configuration. For example, a recording medium may move in the main scanning direction in a state in which a recording head is stopped, and both the recording medium and the recording head may move in the main scanning direction. In addition, a recording medium and a recording head may also be able to relatively move in the sub-scanning direction. For example, it may be a configuration in which a head unit moves in the XY direction with respect to a recording medium which is mounted (fixed) on a table, and performs recording, like a flatbed-type printer. That is, it may be a configuration in which a recording medium and a recording head relatively move in at least one of the main scanning direction and the sub-scanning direction.

Modification Example 2

In the above described embodiments, a printing apparatus which ejects ink onto a printing sheet has been described; however, the invention can also be applied to various dot recording apparatuses other than this, and for example, it also is possible to apply the invention to an apparatus which forms dots by ejecting liquid droplets on a substrate. In addition, a liquid ejecting apparatus which discharges or ejects liquid other than ink may be adopted, and the invention can also be applied to various liquid ejecting apparatuses which include a liquid ejecting head, or the like, which eject liquid droplets of a minute amount. In addition, liquid droplets mean a state of liquid which is ejected from the above described liquid ejecting apparatus, and also include a granular shape, a tear shape, and a thread shape leaving a trail. In addition, the liquid here may be a material which can be discharged using a liquid ejecting apparatus. For example, the liquid may be a material in a state of a liquid phase, and includes materials which flow such as a liquid body having high or low viscosity, a sol, a gel, and inorganic solvent, organic solvent, liquid, a liquid resin, liquid metal (metallic melt) other than that, and includes materials in which particles of a functional material which is formed of a solid body such as a pigment or metal particles are melted, diffused, or mixed in a solvent, not only liquid as a state of the material. As a representative example of the liquid, the ink, liquid crystal, or the like, can be exemplified as described in the above embodiments. Here, the ink includes general water-based ink and oil-based ink, and a variety of liquid compositions such as gel ink, hot-melt ink, or the like. As specific examples of the liquid ejecting apparatus, there may be a liquid ejecting apparatus which ejects liquid including a material such as an electrode material, or a color material which is used when manufacturing, for example, a liquid crystal display, an EL (electroluminescence) display, a surface emission display, a color filter, or the like, in a form of dispersion, or dissolution. In addition, the liquid ejecting apparatus may be a liquid ejecting apparatus which ejects a biological organic substance which is used when manufacturing a biochip, a liquid ejecting apparatus which ejects liquid as a sample which is used as a precision pipette, a textile printing device, a micro-dispenser, or the like. Further, the liquid ejecting apparatus may be a liquid ejecting apparatus which ejects a lubricant to a precision machine such as a clock, a camera, or the like, using a pinpoint, a liquid ejecting apparatus which ejects transparent resin liquid such as UV curable resin for forming a micro bulls-eye (optical lens) which is used in an optical communication element, or the like, onto a substrate, and a liquid ejecting apparatus which ejects an etching liquid such as an acid or alkali for etching a substrate, or the like, may be adopted.

Hitherto, the embodiments of the invention have been described based on some embodiments; however, the above described embodiments of the invention are made to facilitate understanding of the invention, and do not limit the invention. The invention can be modified or improved without departing from the scope and claims of the invention, and equivalents thereof are naturally included in the invention.

This application claims priority to Japanese Patent Application No. 2015-065910 filed on Mar. 27, 2015. The entire disclosure of Japanese Patent Application No. 2015-065910 is hereby incorporated herein by reference.

What is claimed is:

1. A liquid ejecting apparatus comprising:

a plurality of nozzles which eject liquid onto a medium;

a moving portion which relatively moves the plurality of nozzles to the medium; and a control portion which controls the plurality of nozzles and the moving portion, wherein the plurality of nozzles include a first-type nozzle group which records dots by ejecting the liquid using a nozzle use rate which is less than a first threshold value, a second-type nozzle group which records dots by ejecting the liquid using a nozzle use rate which is the first threshold value or more, and less than a second threshold value, and a third-type nozzle group which records dots by ejecting the liquid using a nozzle use rate of the second threshold value or more, and wherein the control portion executes multipass recording in which recording of dots on a main scanning line is completed using main scanning passes of N times (N is integer of 2 or more), ejects the liquid in order of ejecting of the first-type nozzle group and the third-type nozzle group with respect to a first region on the medium, ejects the liquid using the second-type nozzle group with respect to a second region which is close to the first region, and ejects the liquid in order of ejecting of the third-type nozzle group and the first-type nozzle group with respect to a third region which is close to the second region, but is not close to the first region.

2. The liquid ejecting apparatus according to claim 1, wherein the number of nozzles of the first-type nozzle group and the number of nozzles of the third-type nozzle group are the same.

3. The liquid ejecting apparatus according to claim 2, wherein the number of nozzles of the first-type nozzle group, the number of nozzles of the second-type nozzle group, and the number of nozzles of the third-type nozzle group are the same.

4. The liquid ejecting apparatus according to claim 1, wherein the number of times of scanning which is performed while ejecting the liquid, and is necessary for forming the second region is smaller than the number of times of scanning which is performed while ejecting the liquid, and is necessary for forming the first region, and is smaller than the number of times of scanning which is performed while ejecting the liquid, and is necessary for forming the third region.

5. The liquid ejecting apparatus according to claim 1, wherein the first-type nozzle group, the second-type nozzle group, and the third-type nozzle group are arranged in order of the first-type nozzle group, the second-type nozzle group, the third-type nozzle group, the second-type nozzle group, and the first-type nozzle group in a sub-scanning direction.

6. The liquid ejecting apparatus according to claim 1, wherein the nozzle use rate of the first-type nozzle group is 0% or more, and less than 40%, the nozzle use rate of the second-type nozzle group is 40% or more, and less than 60%, and the nozzle use rate of the third-type nozzle group is 60% or more, and 100% or less.

7. A liquid ejecting method in which liquid is ejected to a medium from a plurality of nozzles, and the plurality of nozzles include a first-type nozzle group which performs ejecting using a nozzle use rate which is less than a first threshold value, a second-type nozzle group which performs ejecting using a nozzle use rate which is the first threshold value or more, and less than a second threshold value, and a third-type nozzle group which performs ejecting using a nozzle use rate of the second threshold value or more, the method comprising:

executing recording of dots on a main scanning line using multipass recording in which the recording of dots is completed using main scanning passes of N times (N is integer of 2 or more);

ejecting the liquid in order of ejecting using the first-type nozzle group and the third-type nozzle group with respect to a first region;

executing ejecting using the second-type nozzle group with respect to a second region which is close to the first region; and ejecting the liquid in order of ejecting using the third-type nozzle group and the first-type nozzle group with respect to a third region which is close to the second region, but is not close to the first region.

* * * * *